United States Patent [19]

Christensen

[11] Patent Number: 4,916,763

[45] Date of Patent: Apr. 17, 1990

[54] POOL DECK PROTECTOR

[75] Inventor: Lincoln H. Christensen, County of Vanderburgh, Ind.

[73] Assignee: Anchor Industries, Inc., Evansville, Ind.

[21] Appl. No.: 338,746

[22] Filed: Apr. 17, 1989

[51] Int. Cl.[4] ..... E04H 3/19; E04H 3/18

[52] U.S. Cl. ..... 4/503; 4/496; 4/504; 267/71; 267/169

[58] Field of Search ..... 4/503, 661, 498, 502, 4/504, 496, 502; 24/299, 300, 617; 267/179, 169, 71, 73, 72, 166; 403/229, 291

[56] References Cited

U.S. PATENT DOCUMENTS

| | | | |
|---|---|---|---|
| 1,594,962 | 8/1926 | Jacobs | 267/169 X |
| 2,820,269 | 1/1958 | Wolff | 24/300 X |
| 2,889,165 | 6/1959 | Zientara | 24/300 X |
| 2,958,872 | 11/1960 | Meyer, Jr. | 4/503 |
| 3,229,309 | 1/1966 | Knodel | 4/503 |
| 3,231,950 | 2/1966 | Lummis | 24/300 |
| 3,264,656 | 8/1966 | Clay et al. | 4/503 |
| 3,653,652 | 4/1972 | Lindbery, Jr. | 267/179 X |
| 3,853,343 | 12/1974 | Hunter | 24/299 X |
| 4,351,072 | 9/1982 | Smith | 4/503 |

*Primary Examiner*—Henry K. Artis

*Attorney, Agent, or Firm*—Warren D. Flackbert

[57] ABSTRACT

A pool deck protector comprising an enlarged body portion tapering into narrow elongated strips at either end, where the body portion is adpated to underlie the body of a spring member forming part of a pool cover tensioning arrangement. The aforesaid strips of the deck protector are inserted into opposite ends of the spring member, serving to retain the elongated body portion in a position between the spring member and the upper surface of the pool deck.

4 Claims, 1 Drawing Sheet

POOL DECK PROTECTOR

As is known, the usage of a cover to overlay a swimming pool, as for child safety and/or the unwanted entry of leaves, debris or the like, is widespread. In this connection, and typically, a series of tensioning arrangements, extending from the pool cover to an anchor embedded in the pool deck, may each include a strap or web secured to the cover and engaging one end of a tension spring, where the opposite end of the latter is affixed to the aforesaid anchor.

A principal difficulty with the preceding, however, is the fact that each tension spring is in direct contact with the pool deck, accomplishing actual and/or potential damage to the latter since the deck is usually presented in the form of ceramic tile or other material which is readily scratched. In other words, a series of unsightly damaged areas could result on the deck area around the pool cover.

BRIEF DESCRIPTION OF THE INVENTION

The invention overcomes the preceding by providing a protector which simply, yet effectively, underlays each spring and prevents direct contact between the spring and the surface of the pool deck. The body of the protector has a width greater than the diameter of the spring and tapers into end strips which are received within the body of the spring for securement/placement purposes.

BRIEF DESCRIPTION OF THE FIGURES

In any event, a better understanding of the present invention will become more apparent from the following description, taken in conjunction with the accompanying drawing, wherein.

Figure 1:
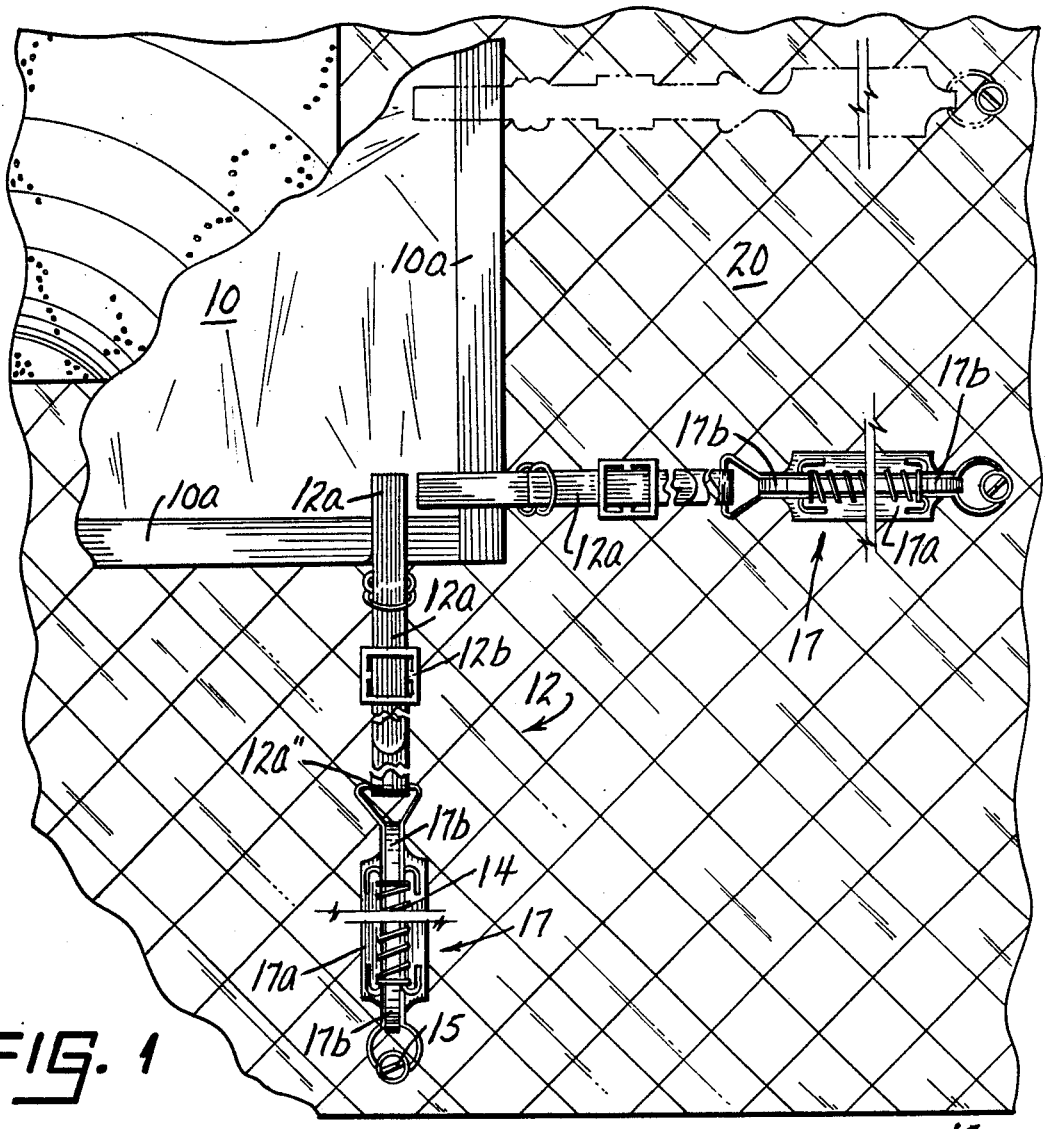
FIG. 1 is a top plan view of an installation employing a pool deck protector in accordance with the teachings of the present invention.
Figure 2:
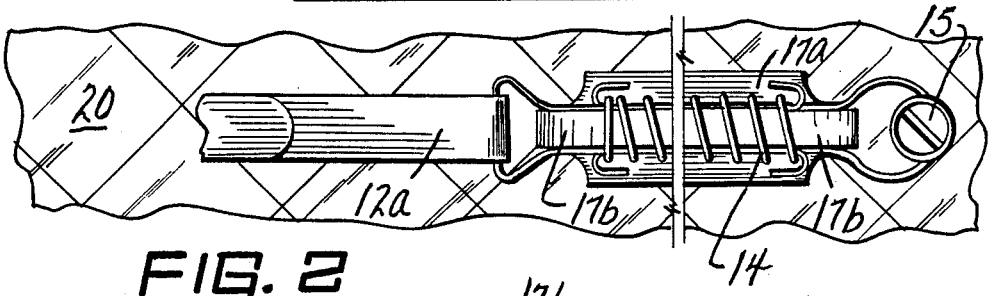
FIG. 2 is a detailed and enlarged plan view of the instant pool deck protector; and, FIG. 3 is a view in side elevation, further detailing the pool deck protector at a use condition.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the pool deck protector of the invention is shown in connection with a conventional pool cover 10, typically hemmed, at 10*a*, along its free edges. Various pool cover tensioning arrangements 12 are employed, each including a web portion 12*a* having one end 12*a'* secured to the pool cover 10 and another end 12*a''* encircling an end of a tension spring 14. Horizontal adjustment is achieved through a buckle 12*b*. The other end of tension spring 14 encircles an anchor 15 embedded in pool deck 20 at an epoxy resin filled drilled hole.

The illustrated tension spring 14 is of a type which is commercially available, but which, without the use of the invention, would directly engage the surface of the pool deck 20 and, typically, cause surface scratching, chipping and/or the like, resulting in unsightly damage.

Figure 3:
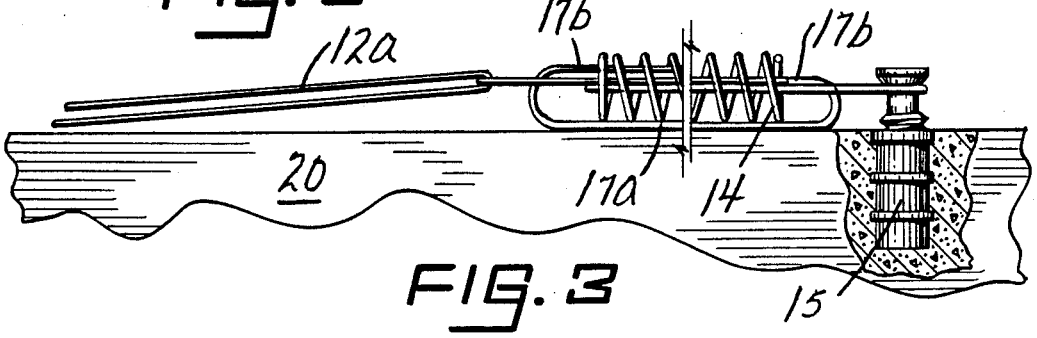

The instant pool deck protector 17 is defined by an enlarged body portion 17*a* extending longitudinally with respect to the spring 14 and tapering into elongated relatively narrow strips 17*b* at either end, where the latter strips 17*b*, after insertion within the space presented by the helical rings of tension spring 14, serve protector 17 placement/securement purposes. FIG. 3 presents a positive portrayal of the preceding relationship.

In any event, the enlarged body portion 17*a* of the protector 17 serves to accommodate and block any direct engagement of the spring member 14 with the surface of deck 20, even if spring 14 moves somewhat laterally. Any unwanted loosening of the instant pool deck protector 17 is prevented by the locking action afforded through the positioning of the opposite end strips 17*b* of the protector 17 into the open ends of the tension spring member 14.

From the preceding it should be evident that the pool deck protector described hereabove effectively prevents deck damage due to a common pool cover tie-down arrangement employing a tension spring member. The protector herein is typically fabricated from a tough, yet flexible material—one which is conducive to ease in placement, yet at the same time precludes damage.

The pool deck protector described hereabove is susceptible to various changes within the spirit of the invention, including, by way of example, in the proportioning; the particular type of spring member with which it may be employed; the overall plan view configuration thereof; and, the like. Thus, the preceding should be considered illustrative and not as limiting the scope of the following claims.

I claim:

1. A pool deck protector for use in combination with a tie-down arrangement for a pool cover surrounded by a pool deck which includes an anchoring member, a tension spring overlying said deck and webbing interconnecting the pool cover with the anchoring member said protector, comprising an enlarged body portion adapted to extend longitudinally with respect to said spring between said spring and said pool deck and tapering into narrow elongated strips at either end thereof, where said protector is retained in position by the placement of each of said elongated strips within said spring.

2. The pool deck protector of claim 1 where said strips each extend into a cavity presented by said spring.

3. The pool deck protector of claim 1 where said spring connects said anchoring member at one end and pool cover webbing at an opposite end.

4. The pool deck protector of claim 1 where flexible material defines said enlarged body portion and said strips.

* * * * *